US010966529B1

(12) United States Patent
Downs

(10) Patent No.: US 10,966,529 B1
(45) Date of Patent: Apr. 6, 2021

(54) PORTABLE WORKSTATION

(71) Applicant: Jolie Downs, Santa Cruz, CA (US)

(72) Inventor: Jolie Downs, Santa Cruz, CA (US)

( * ) Notice: Subject to any disclaimer, the term of this patent is extended or adjusted under 35 U.S.C. 154(b) by 12 days.

(21) Appl. No.: 16/584,696

(22) Filed: Sep. 26, 2019

(51) Int. Cl.

| | |
|---|---|
| ***A47C 4/28*** | (2006.01) |
| ***A47C 7/66*** | (2006.01) |
| ***A47C 7/70*** | (2006.01) |
| ***A47C 7/62*** | (2006.01) |
| *A45F 3/08* | (2006.01) |
| *A45F 4/02* | (2006.01) |
| *A47C 4/52* | (2006.01) |

(52) U.S. Cl.
CPC ..... *A47C 4/283* (2013.01); *A47C 7/624* (2018.08); *A47C 7/66* (2013.01); *A47C 7/70* (2013.01); *A45F 3/08* (2013.01); *A45F 4/02* (2013.01); *A47C 4/52* (2013.01)

(58) Field of Classification Search
CPC ..... A47C 4/283; A47C 4/52; A47C 7/624; A47C 7/66; A47C 7/70; A45F 4/02; A45F 3/08
See application file for complete search history.

(56) References Cited

U.S. PATENT DOCUMENTS 2,746,526 A * 5/1956 Loeschnigg ..... A47C 7/72 297/161
3,632,161 A * 1/1972 Arfaras ..... A47C 7/70 297/145
3,999,798 A * 12/1976 Roulier ..... A47C 7/70 297/150
4,159,071 A * 6/1979 Roca ..... A47C 7/70 108/42
4,487,345 A 12/1984 Pierce et al.
4,676,548 A 6/1987 Bradbury
5,350,215 A * 9/1994 DeMars ..... A47C 7/66 297/188.14
5,409,291 A 4/1995 Lamb et al.
6,296,002 B1 * 10/2001 Tashchyan ..... A47C 4/283 135/115
6,976,733 B1 12/2005 Biederman et al.
D572,508 S * 7/2008 Tagliati ..... D6/716
7,506,923 B1 * 3/2009 Gauss ..... B60N 3/002 297/149

(Continued)

FOREIGN PATENT DOCUMENTS

KR 20030010363 A * 2/2003 ..... A47C 7/70
WO WO2011096915 A1 8/2011

*Primary Examiner* — Syed A Islam

(57) ABSTRACT

A portable workstation is an apparatus that provides a work seat, surface, and convenient resources for desk work. The apparatus is also configured to collapse for ease of transport. The apparatus includes a chair frame, a pack, a backing, a first telescoping table panel, a second telescoping table panel, a first shoulder strap, and a second shoulder strap. The chair frame provides support for the user. The pack can be utilized to store a laptop, chargers, paper, writing implements, and other items. The backing serves as protection for the collapsing components in the closed configuration. The first telescoping table panel and the second telescoping table panel extend into operative and resting positions relative to each other. The first shoulder strap works in conjunction with the second shoulder strap to provide a mechanism for the user to conveniently carry the apparatus.

14 Claims, 12 Drawing Sheets

(56) References Cited

U.S. PATENT DOCUMENTS

| | | | | |
|---|---|---|---|---|
| D683,550 | S | 6/2013 | Ammann, Jr. | |
| 8,517,462 | B2 * | 8/2013 | Birch | A47C 4/52 297/4 |
| 8,864,221 | B1 | 10/2014 | Delvilla | |
| 9,049,916 | B2 * | 6/2015 | Berei | A47C 4/52 |
| 9,192,235 | B2 * | 11/2015 | Horowitz | A47C 7/70 |
| 9,655,453 | B2 * | 5/2017 | Starck | A47C 4/283 |
| 9,775,438 | B1 * | 10/2017 | Schulenberg | A47C 4/283 |
| 9,801,366 | B2 * | 10/2017 | Ruybal | A47C 7/66 |
| 9,820,568 | B2 * | 11/2017 | Johnson | A47B 23/06 |
| 9,943,174 | B1 * | 4/2018 | Jacobs | A61H 23/004 |
| 2013/0214565 | A1 * | 8/2013 | Nickell | A47C 7/62 297/30 |
| 2015/0084381 | A1 * | 3/2015 | Nelson | A47C 7/506 297/4 |
| 2015/0122860 | A1 * | 5/2015 | Berei | A45F 3/04 224/576 |
| 2015/0366357 | A1 * | 12/2015 | Nelson | A47C 7/506 297/35 |
| 2017/0332794 | A1 * | 11/2017 | Melaragno | A47B 5/02 |
| 2018/0192776 | A1 * | 7/2018 | Scrone-Smith | A47C 1/12 |
| 2019/0313799 | A1 * | 10/2019 | Frankel | A47C 7/70 |

* cited by examiner

PORTABLE WORKSTATION

FIELD OF THE INVENTION

The present invention generally relates to a mobile seat. More specifically, the present invention relates to a chair with a desk surface that collapses into a wearable backpack structure. The present invention allows a user to work from a variety of locations.

BACKGROUND OF THE INVENTION

The office workspace is becoming obsolete with the advent of remote working capabilities. Virtual private networks and other remote access mechanisms provide users with the ability to work from the comfort of their homes or the convenience of the road, and while there is no perfect substitute for the communication made possible by in-person meetings, there are replacements like video calls that are reasonable replacements. The potential to avoid the perils and costs associated with a daily commute is valuable, as incidents can be reduced with fewer people on the road and worker money can be preserved. Overall, the advantages of remote work for worker health and convenience are too high to be ignored.

While the various means by which a user can interact with their work are increasing, the tools available to take advantage of such technology are lacking. Even working from home can become a binding experience if the worker is still bound to a desktop computer. A laptop increases the portability of the potential workspace by allowing a user to travel to different locations without being tethered to a desktop; however, even this has limitations. The user is still often bound to proximity to electrical outlets in order to charge their laptop. Further, a variety of other tools, such as desks, working surfaces, laptop cases and containers, and other such devices are required to fully enable a working environment. Even upon accumulation of appropriate tools and working materials, there is no guarantee that the area you have set up in will remain appropriate for work in relation to ambient noise and foot traffic. What is needed is a way to conveniently set up a work environment. Further desirable is a structure that provides power, protection, and convenience for all necessary electronics.

The present invention addresses these issues. A portable workstation provides the user with the ability to set up an appropriate work environment anywhere, including outdoors. The present invention utilizes a frame that supports the user above the ground, or whatever surface is chosen as an appropriate area for work. A portable power supply allows the user to store and access electrical charge for various devices. The seat of the present invention folds into a fully functioning backpack, thereby enabling the user to travel with items and the full workstation in tow. A telescoping desk provides the user with a flat surface upon which to place a laptop, writing implements, paper, or other work materials.

DETAILED DESCRIPTION OF THE INVENTION

All illustrations of the drawings are for the purpose of describing selected versions of the present invention and are not intended to limit the scope of the present invention.

Figure 1:
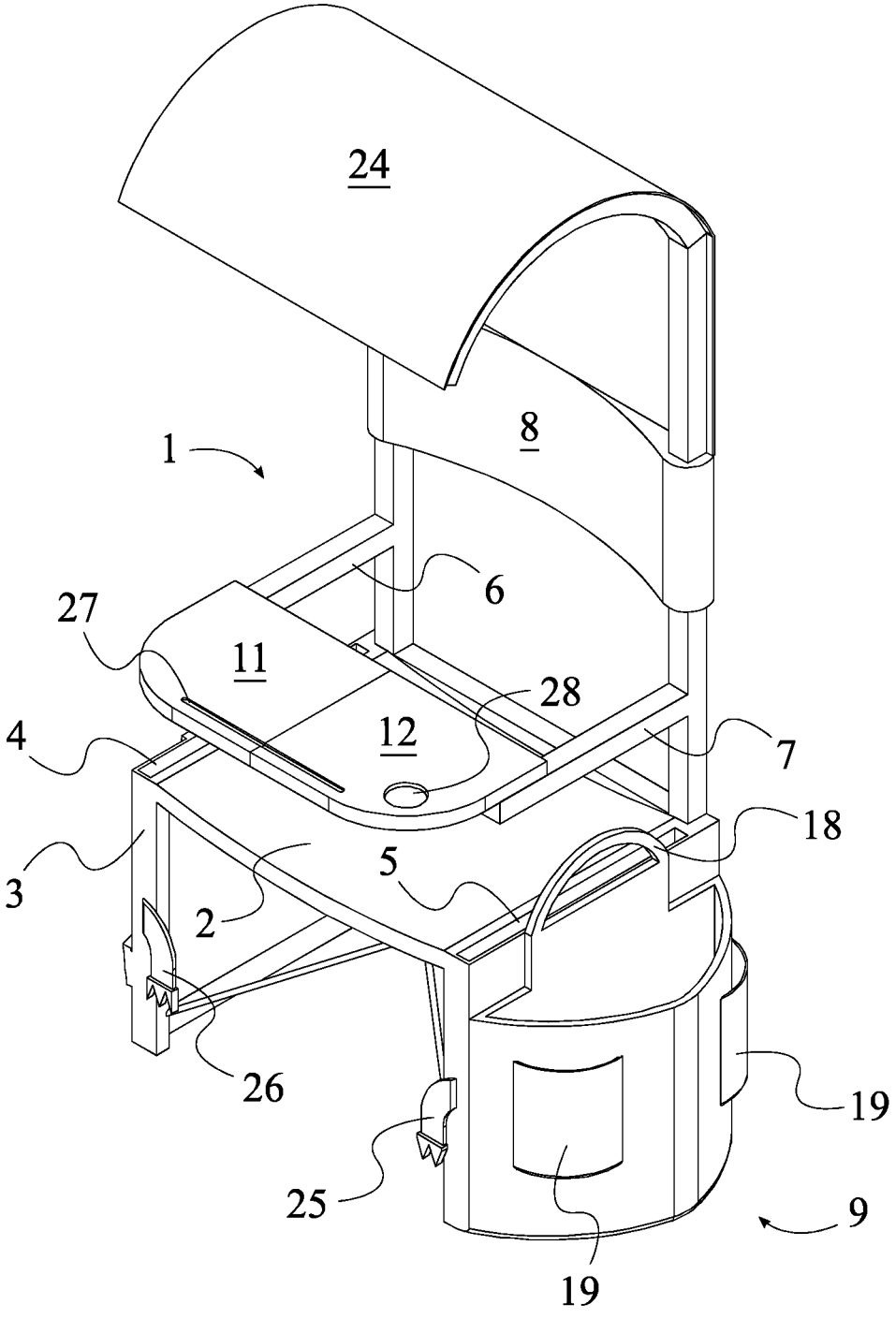
FIG. 1 is a front-left perspective view of the present invention.
Figure 2:
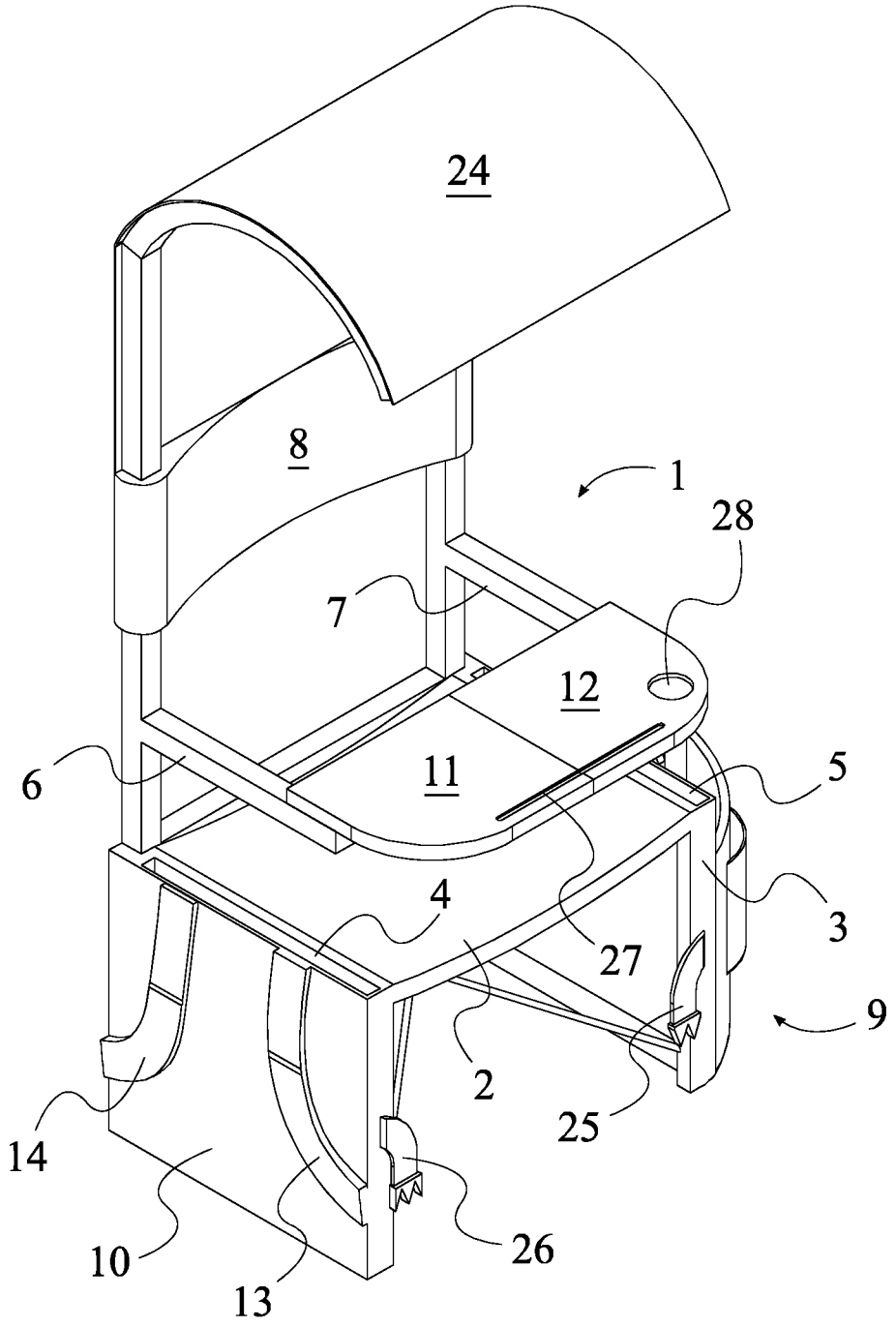
FIG. 2 is a front-right perspective view of the present invention.

The present invention is a portable workstation that is used to provide a work seat, surface, and convenient resources for desk work. The present invention is also configured to collapse into a container for ease of transport. The present invention comprises a chair frame 1, a pack 9, a backing 10, a first telescoping table panel 11, a second telescoping table panel 12, a first shoulder strap 13, and a second shoulder strap 14, as seen in FIGS. 1 and 2. The chair frame 1 is the structure that provides support for the backing 10 and the seat 2. The pack 9 is a container that can be utilized to store a laptop, chargers, paper, writing implements, and other items as well as the collapsing components in the closed configuration. The backing 10 is a panel that serves as protection for the collapsing components in the closed configuration. The first telescoping table panel 11 is a support that extends into operative and resting positions relative to the second telescoping table panel 12. Similarly, the second telescoping table panel 12 is a support that extends into operative and resting positions relative to the first telescoping table panel 11. The first telescoping table panel 11 and the second telescoping table panel 12 provide a user of the present invention with a workspace. The first shoulder strap 13 is a preferably padded structure which works in conjunction with the second shoulder strap 14 to provide a mechanism for the user to conveniently carry the present invention.

The general configuration of the aforementioned components allows the present invention to efficiently and effectively collapse into a wearable knapsack and expand into a workstation. The chair frame 1 comprises a seat 2, a plurality of folding legs 3, a first pocket 4, a second pocket 5, a first armrest 6, and a second armrest 7, as seen in FIG. 1. The seat 2 is a supported cushion that elevates the user above the ground. The plurality of folding legs 3 is a set of rigid extrusions that join such that the plurality of folding legs 3 extends into a sturdy configuration for support of the seat 2. The first pocket 4 and the second pocket 5 are openings into which the user may place items for storage and convenient access. The first armrest 6 is a device that provides support for an arm of the user. Similarly, the second armrest 7 is a device that provides support for the other arm of the user.

The first pocket 4, the second pocket 5, and the plurality of folding legs 3 are peripherally mounted to the seat 2. Thus, the seat 2 elevates off the ground and provides access to the first pocket 4 and the second pocket 5. The first pocket 4 and second pocket 5 are positioned opposite to each other about the seat 2. This arrangement enables the user to store items conveniently adjacent to either of the arms of the user. The plurality of folding legs 3 is distributed about the seat 2. In this way, the plurality of folding legs 3 provides support that spans the width of the seat 2. The first armrest 6 and the second armrest 7 are mounted offset from the seat 2. By mounting the first armrest 6 and the second armrest 7 away from the seat 2, the first armrest 6 and the second armrest 7 are optimally positioned for resting the arms of the user during work or while relaxing. The first armrest 6 is positioned adjacent to the first pocket 4. Furthermore, the first telescoping table panel 11 is laterally mounted onto the first armrest 6. Such connections enable convenient positioning of the first pocket 4 relative to the user's arm and simultaneously ensure that the first telescoping table panel 11 is appropriately positioned for the expansion of a table over the first armrest 6. Similarly, the second armrest 7 is positioned adjacent to the second pocket 5. Furthermore, the second telescoping table panel 12 is laterally mounted onto the second armrest 7. Such connections enable convenient positioning of the second pocket 5 relative to the user's other arm and simultaneously ensure that the second telescoping table panel 12 is appropriately positioned for the expansion of a table over the second armrest 7, opposite the first telescoping table panel 11.

Figure 3:
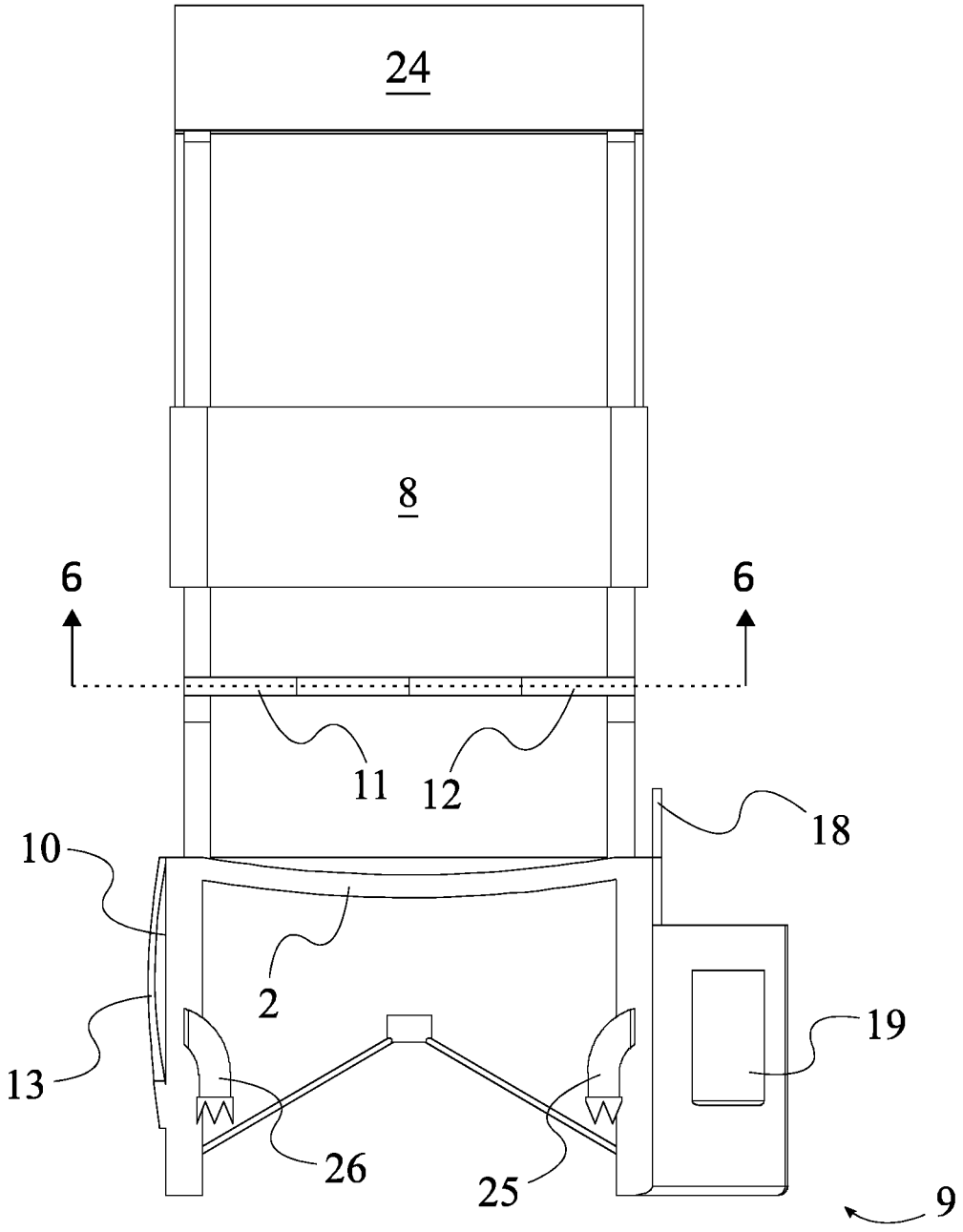
FIG. 3 is a front view of the present invention.

The present invention must be capable of collapsing into a transportable configuration. To this end, the pack 9 is laterally mounted to the first pocket 4, opposite to the seat 2, as seen in FIG. 3. Thus, the pack 9 is positioned so that the chair frame 1 collapses into the pack 9. The backing 10 is laterally mounted to the second pocket 5, opposite the seat 2. The backing 10 is therefore positioned optimally to allow for support of the present invention while the user wears or otherwise transports the present invention on the user's back. The first shoulder strap 13 and the second shoulder strap 14 are mounted adjacent to the backing 10, opposite the second pocket 5. Such positioning provides a comfortable and intuitive mechanism by which the user may transport the present invention. The first shoulder strap 13 is also positioned offset from the second shoulder strap 14. In this way, the first shoulder strap 13 and the second shoulder strap 14 are positioned appropriately to receive the user's arms.

Figure 6:
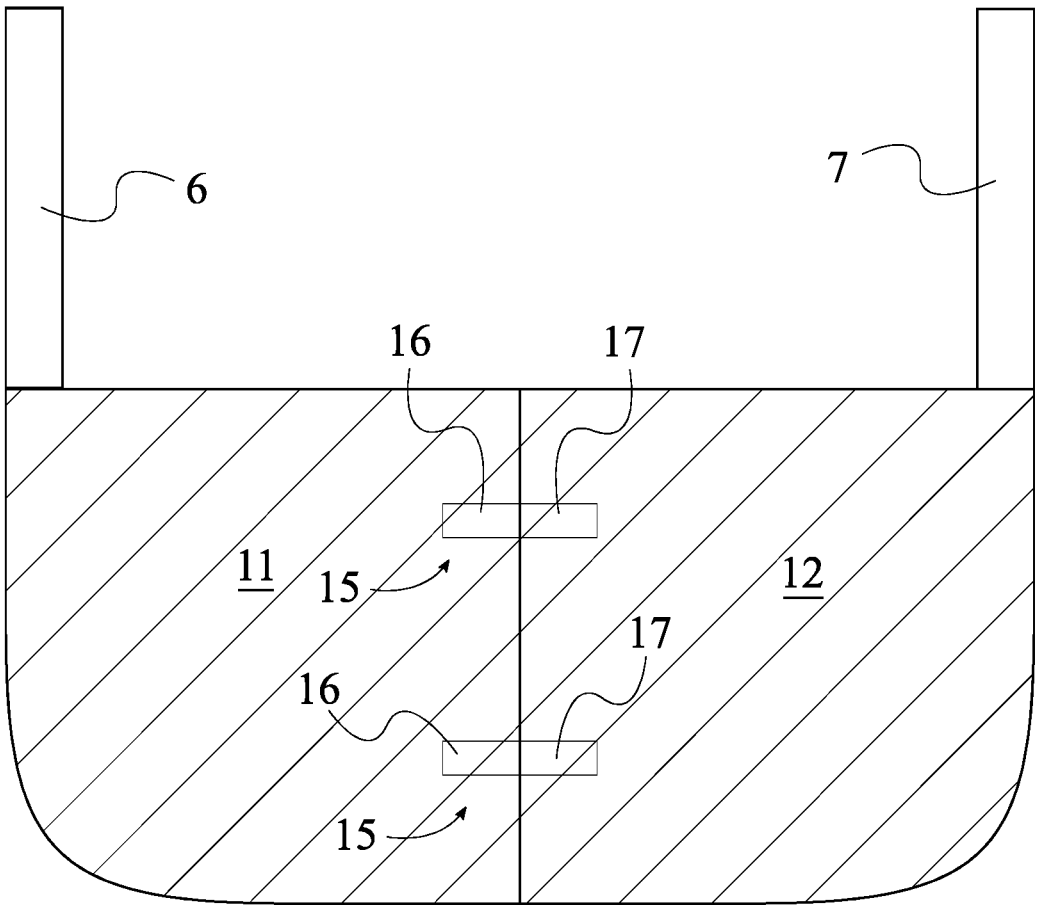
FIG. 6 is a cross-sectional view taken along line 5-5 in FIG. 3 of the present invention.

Several components that allow for the user to collapse the present invention are provided. The present invention comprises a panel-joining mechanism 15, as seen in FIG. 6. The panel-joining mechanism 15 is a set of surfaces or other semirigid structures utilized for creating and maintaining a flat surface upon which a user may work. The panel-joining mechanism 15 comprises a first panel interlocking piece 16 and a second panel interlocking piece 17. The first panel interlocking piece 16 and the second panel interlocking piece 17 are structures that engage each other to create and sustain a flat working surface. The first panel interlocking piece 16 is laterally integrated into the first telescoping table panel 11, opposite the first armrest 6. Similarly, the second panel interlocking piece 17 is laterally integrated into the second telescoping table panel 12, opposite the second armrest 7. Thus, the first panel interlocking piece 16 and the second panel interlocking piece 17 engage each other to create the working surface from the first panel interlocking piece 16 and the second panel interlocking piece 17.

The first panel interlocking piece 16 and the second panel interlocking piece 17 must be joined together such that the desk area cannot collapse or break during use. To this end, the first panel interlocking piece 16 and the second panel interlocking piece 17 are magnetically engaged to each other, as seen in FIG. 6. Such engagement ensures that the working surface remains flat and unbroken during use. In alternative embodiments, the first panel interlocking piece 16 and the second panel interlocking piece 17 overlap, thus preventing the first panel interlocking piece 16 from sliding past the second panel interlocking piece 17.

Figure 4:
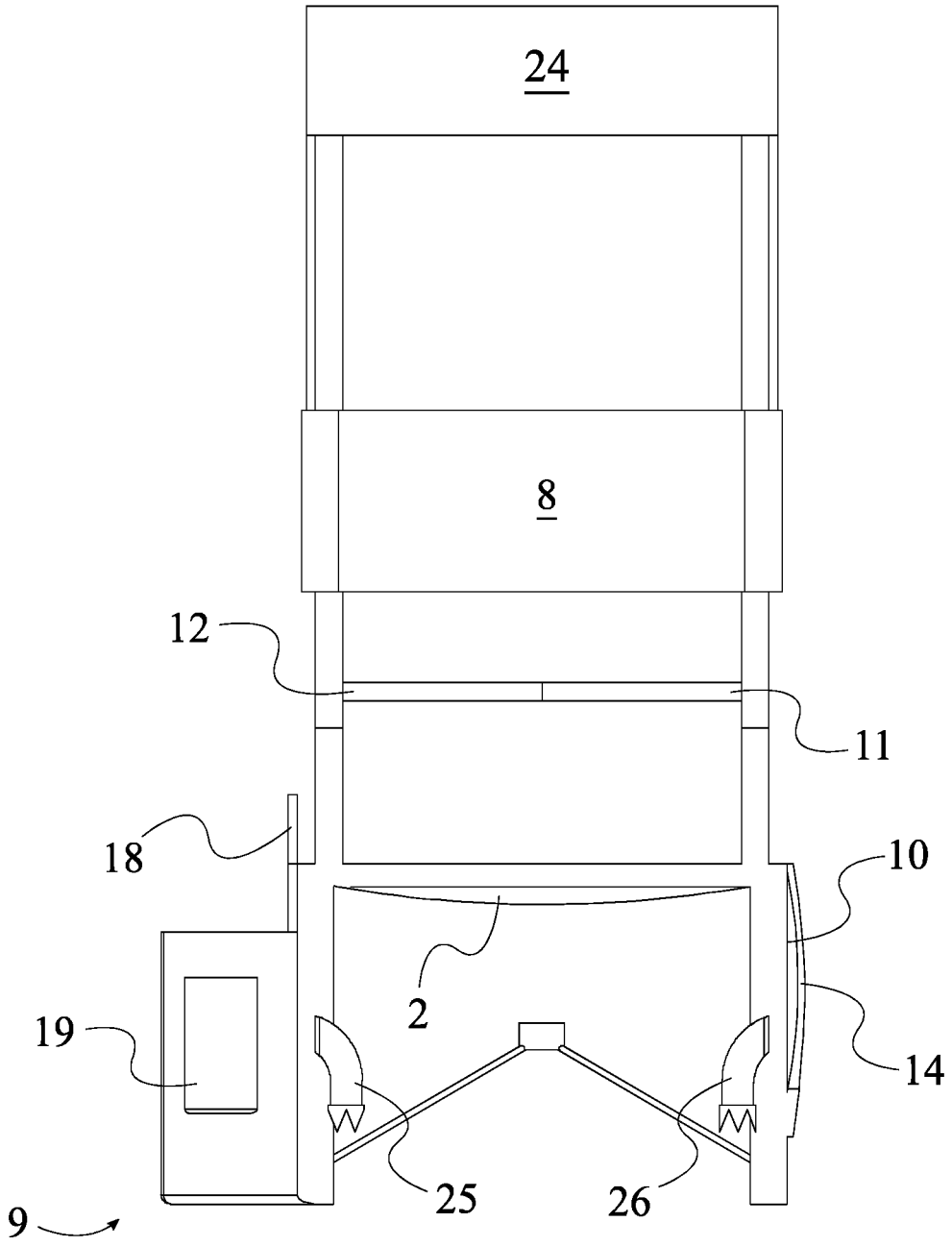
FIG. 4 is a rear view of the present invention.

To further facilitate the convenience of handling and moving the present invention, the present invention must include alternatives to the first shoulder strap 13 and the second shoulder strap 14 as mechanisms for carriage. To this end, the present invention comprises a handle 18, as seen in FIGS. 3 and 4. The handle 18 is a generally curved grip extending from the present invention. The handle 18 is mounted adjacent to the pack 9, opposite the first pocket 4. This arrangement is particularly advantageous for carrying the present invention without utilizing the first shoulder strap 13 and the second shoulder strap 14.

In order to accommodate different work or leisure items, such as writing implements, snacks, tools, or more, the pack 9 must be equipped with external storage compartments or other similar features. To this end, the present invention comprises a plurality of ancillary pockets 19, as seen in FIG. 1. The plurality of ancillary pockets 19 is a set of openings which are arranged to hold and protect contained items. The plurality of ancillary pockets 19 is mounted adjacent to the pack 9, opposite the first pocket 4. Furthermore, the plurality of ancillary pockets 19 is distributed across the pack 9. This arrangement ensures easy availability of supplemental storage.

Figure 7:
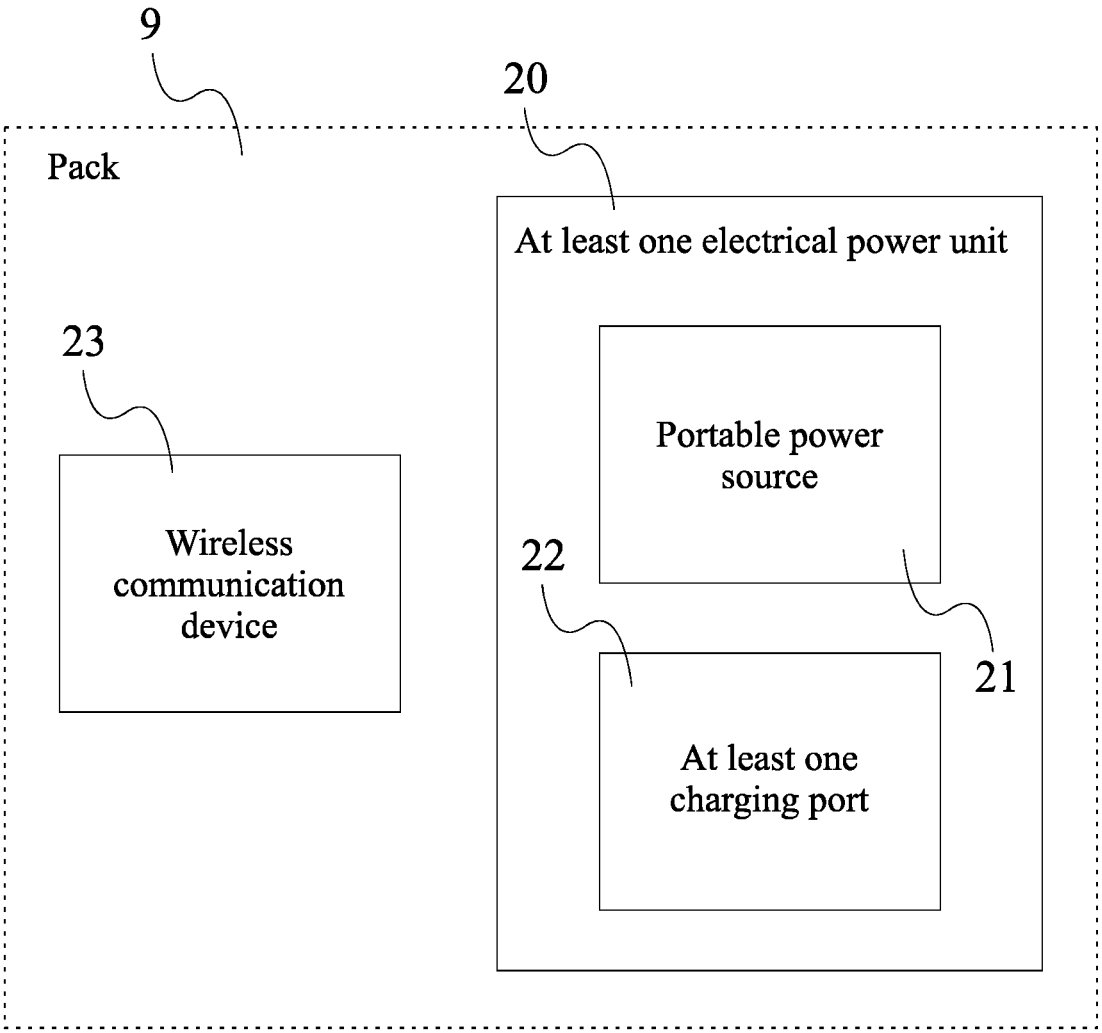
FIG. 7 is a block diagram representing the electronic connections of the present invention.

The user may utilize the present invention with any of a variety of electronic devices, such as smartphones or personal computers. The present invention therefore provides at least one electrical power unit 20, as seen in FIG. 7. The at least one electrical power unit 20 relates to any of a variety of batteries or other electrical energy storage modules capable of providing and regulating appropriate electrical power to connected devices. The at least one electrical power unit 20 comprises a portable power source 21 and at least one charging port 22. The portable power source 21 is a battery capable of sustaining charge for a lengthy amount of time. The at least one charging port 22 is an input port that may refer to any or several of an outlet, a USB port, or a variety of other device-charging inputs. The portable power source 21 is mounted adjacent to the pack 9, opposite the first pocket 4. Thus, the portable power source 21 is easily accessible for upkeep and maintenance. The at least one charging port 22 is electrically integrated into the portable power source 21. This arrangement allows the portable power source 21 to distribute power through that at least one charging port 22.

While working remotely, many users will need internet connectivity to do their jobs. In order to provide for such an occasion, the present invention comprises a wireless communication device 23, as seen in FIG. 7. The wireless communication device 23 is any of a variety of internet connectivity modules capable of receiving and displaying internet content (e.g. a hotspot mobile device). The wireless communication device 23 is mounted adjacent to the pack 9, opposite the first pocket 4. Such placement is optimal for providing a clear signal to the user and for providing proximity to the at least one electrical power unit 20.

In order to accommodate users that may wish to recline while resting in the seat 2, the chair frame 1 is equipped to provide lumbar support to the user. The chair frame 1 further comprises a chair back 8, as seen in FIG. 3. The chair back 8 is a rigid section against which the user may recline in order to rest while in a sitting position. The chair back 8 is peripherally mounted to the seat 2. Such an arrangement provides the user with the opportunity to recline while sitting. The chair back 8 is positioned in between the first armrest 6 and the second armrest 7. In this way, the user is provided with options for sitting upright, reclining against the chair back 8, and relaxing both arms against the first armrest 6 and the second armrest 7.

Oftentimes, particularly while working outside, the user of the present invention suffers from an inability to properly view the screen of their personal computing device resulting from the presence of a glare or an unfortunately bright area. To counter the effects of excessive sunlight, the present invention comprises a collapsible shading cover 24, as seen in FIG. 1. The collapsible shading cover 24 is an opaque cover that prevents excessive sunlight from entering the space around the chair frame 1. The collapsible shading cover 24 is laterally connected to the chair back 8. This arrangement structurally supports the collapsible shading cover 24 over the workspace of the user. Furthermore, the shading cover is positioned offset from the seat 2. Thus, the user is provided ample space to occupy while working or otherwise utilizing the present invention.

Figure 8:
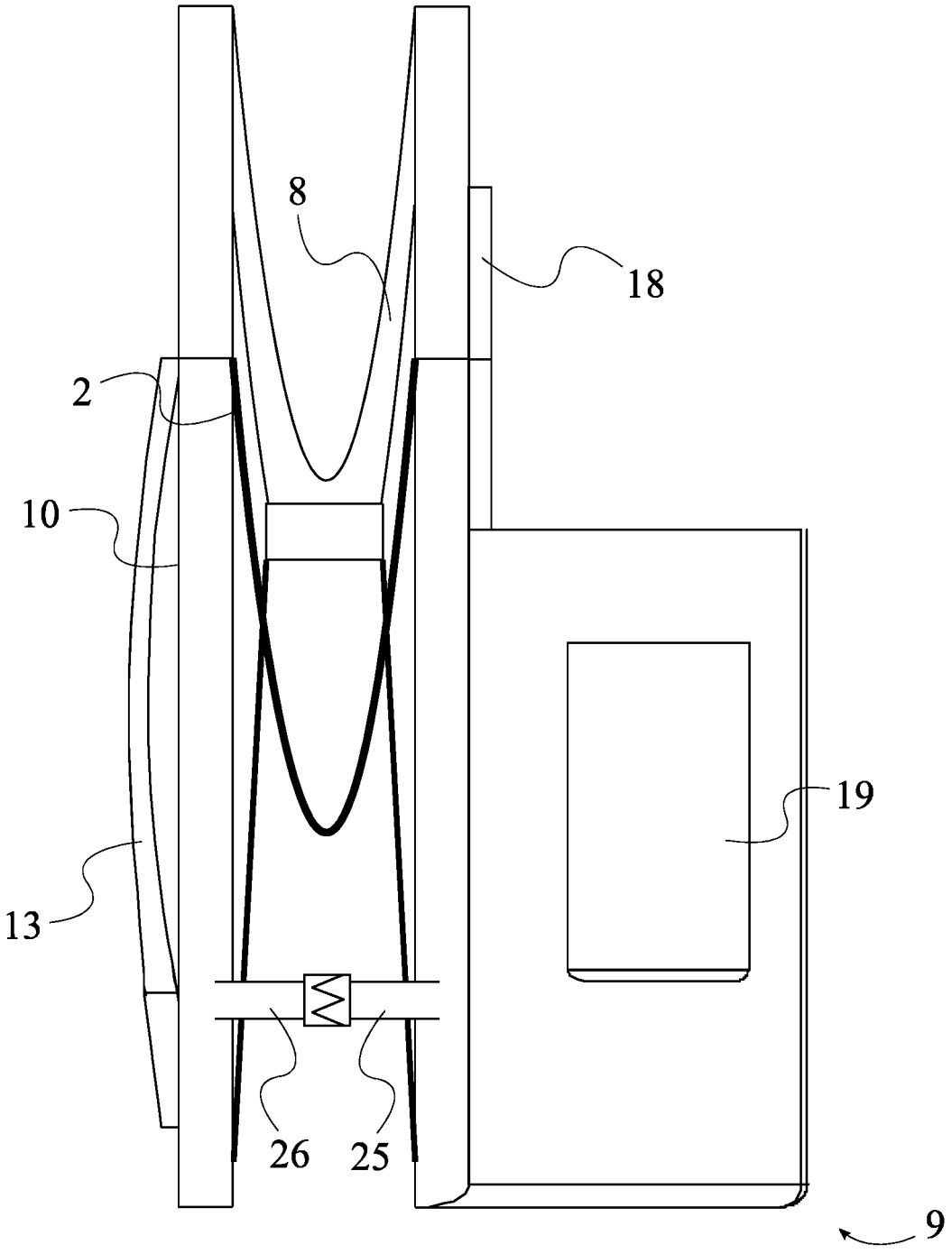
FIG. 8 is a schematic diagram representing a front view of the present invention in a collapsed configuration.
Figure 9:
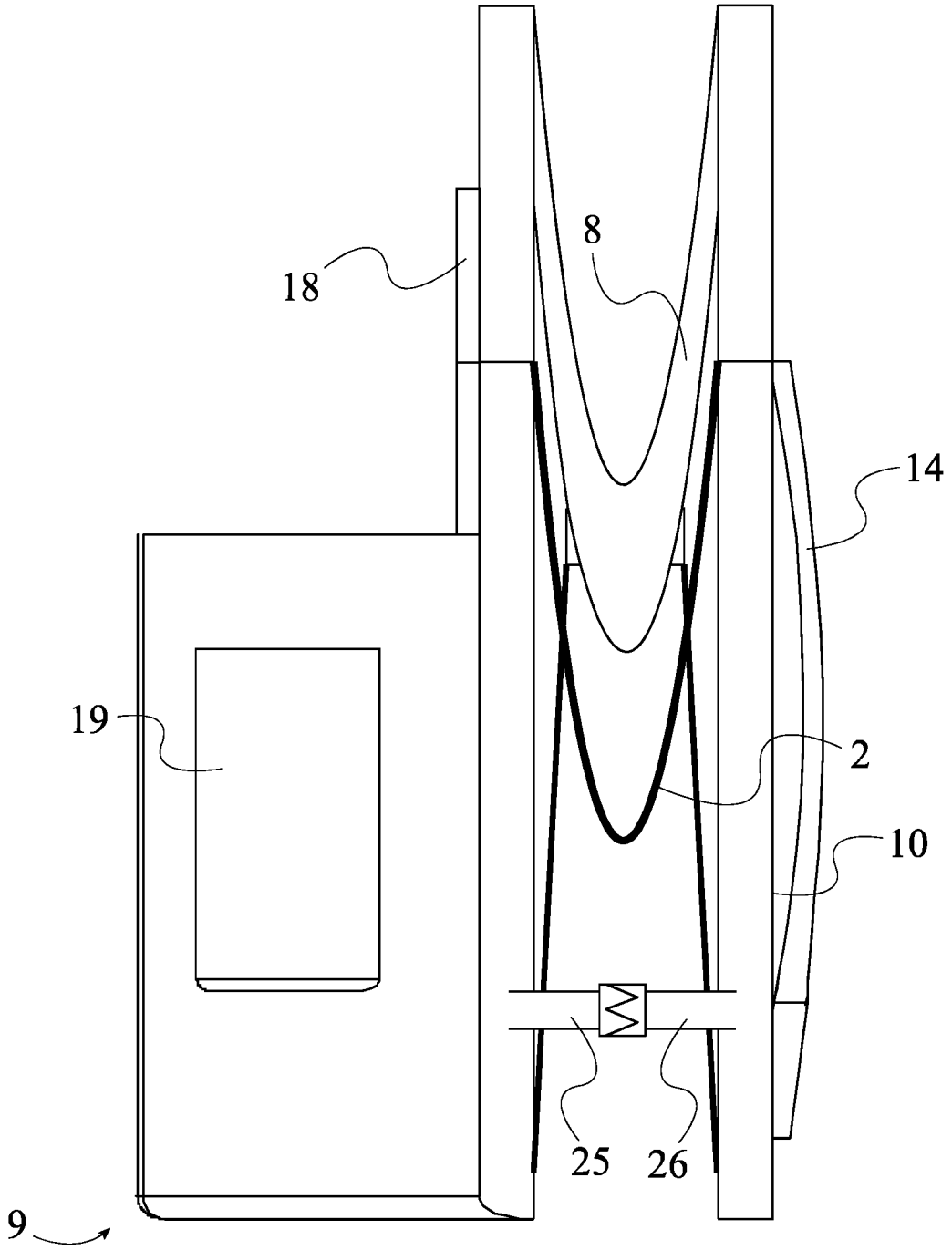
FIG. 9 is a schematic diagram representing a back view of the present invention in a collapsed configuration.

In the collapsed configuration, the user may want an intuitive closure mechanism that is both secure and convenient. To provide such a mechanism, the present invention comprises a plurality of first buckle pieces 25 and a plurality of second buckle pieces 26, as seen in FIGS. 8 and 9. Each of the plurality of first buckle pieces 25 is a clips which connects into a corresponding buckle piece of the plurality of second buckle pieces 26. The plurality of first buckle pieces 25 is peripherally connected to the pack 9. Conversely, the plurality of second buckle pieces 26 is peripherally connected to the backing 10. Such an arrangement of the plurality of first buckle pieces 25 and the plurality of second buckle pieces 26 results in convenient positioning that allows the plurality of first buckle pieces 25 to clip into the plurality of second buckle pieces 26.

Figure 5:
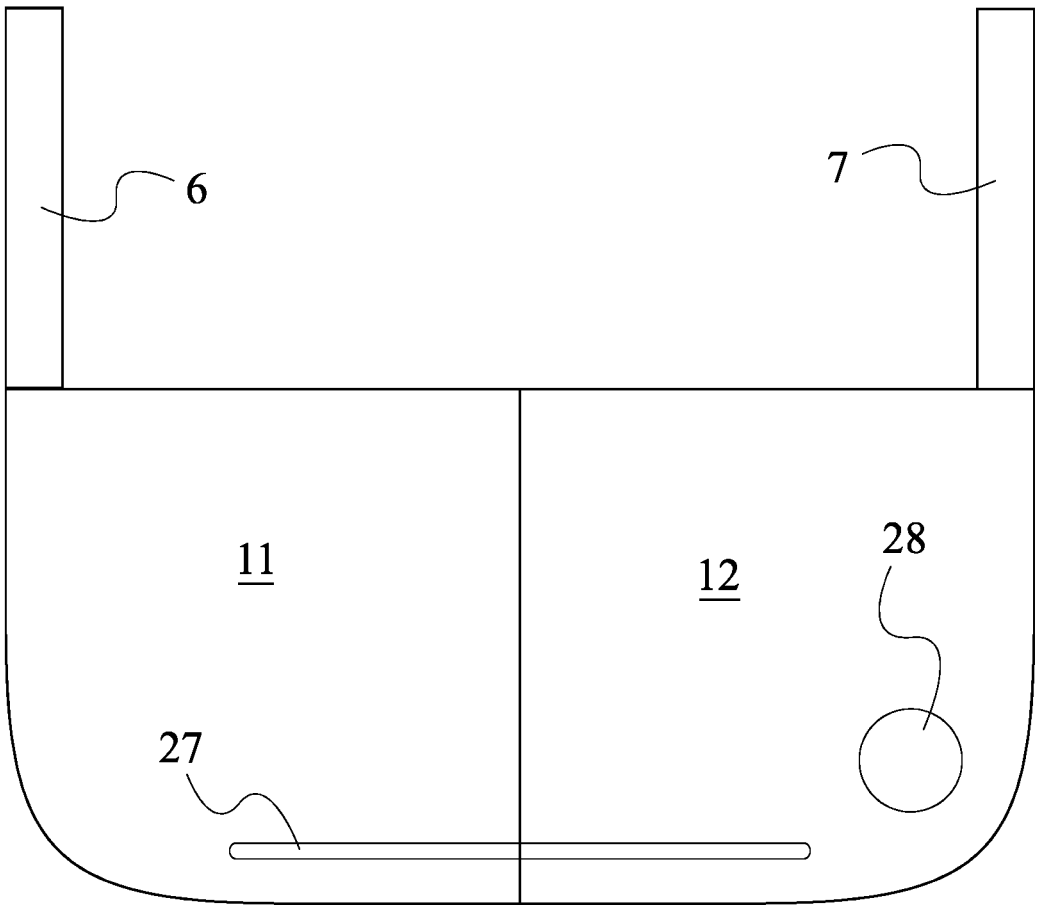
FIG. 5 is a top view of the first and the second telescoping table panels of the present invention.

The user may be a writer or artist and consequently may require a convenient location to securely place pencils and pens where they will not roll away. To this end, the present invention comprises at least one first utensil-bracing indent 27, as seen in FIG. 5. The at least one first utensil-bracing indent 27 is a cut that accommodates pencils and pens, cradling them in order to prevent pencils and pens from rolling off the work surface. The at least one first utensil-bracing indent 27 is integrated into the first telescoping table panel 11. In this way, the at least one first utensil-bracing indent 27 is positioned to retain cylindrical items during use. Similarly, the user may desire to hold drinks or other items on the work surface. To this end, the present invention comprises at least one second utensil-bracing indent 28. The at least one second utensil-bracing indent 28 is a generally circular cut that provides intuitive temporary organization of drinks or other items. The at least one second utensil-bracing indent 28 is integrated into the second telescoping table panel 12. In this way, the at least one second utensil-bracing indent 28 is positioned for convenience to the user while the user sits within the seat 2 while the present invention is in the operative configuration.

The present invention may be in different configurations depending on whether the user is intending to utilize the seat 2 of the present invention. In one such circumstance, the chair frame 1, the pack 9, the backing 10, the first telescoping table panel 11, and the second telescoping table panel 12 are arranged in an operative configuration, as seen in FIG. 1. The operative configuration is that which is utilized in order to work or sit in the seat 2. The pack 9 and the backing 10 are positioned offset from each other. This provides space for the user to sit during use. The first armrest 6 and the second armrest 7 are positioned parallel to the seat 2. In this way, the user is able to rest the user's arms atop the first armrest 6 and the second armrest 7. Furthermore, the first telescoping table panel 11 and the second telescoping table panel 12 are positioned parallel to the seat 2. This provides a flat working surface upon which the user may write, place electronic devices, or otherwise utilize.

Figure 10:
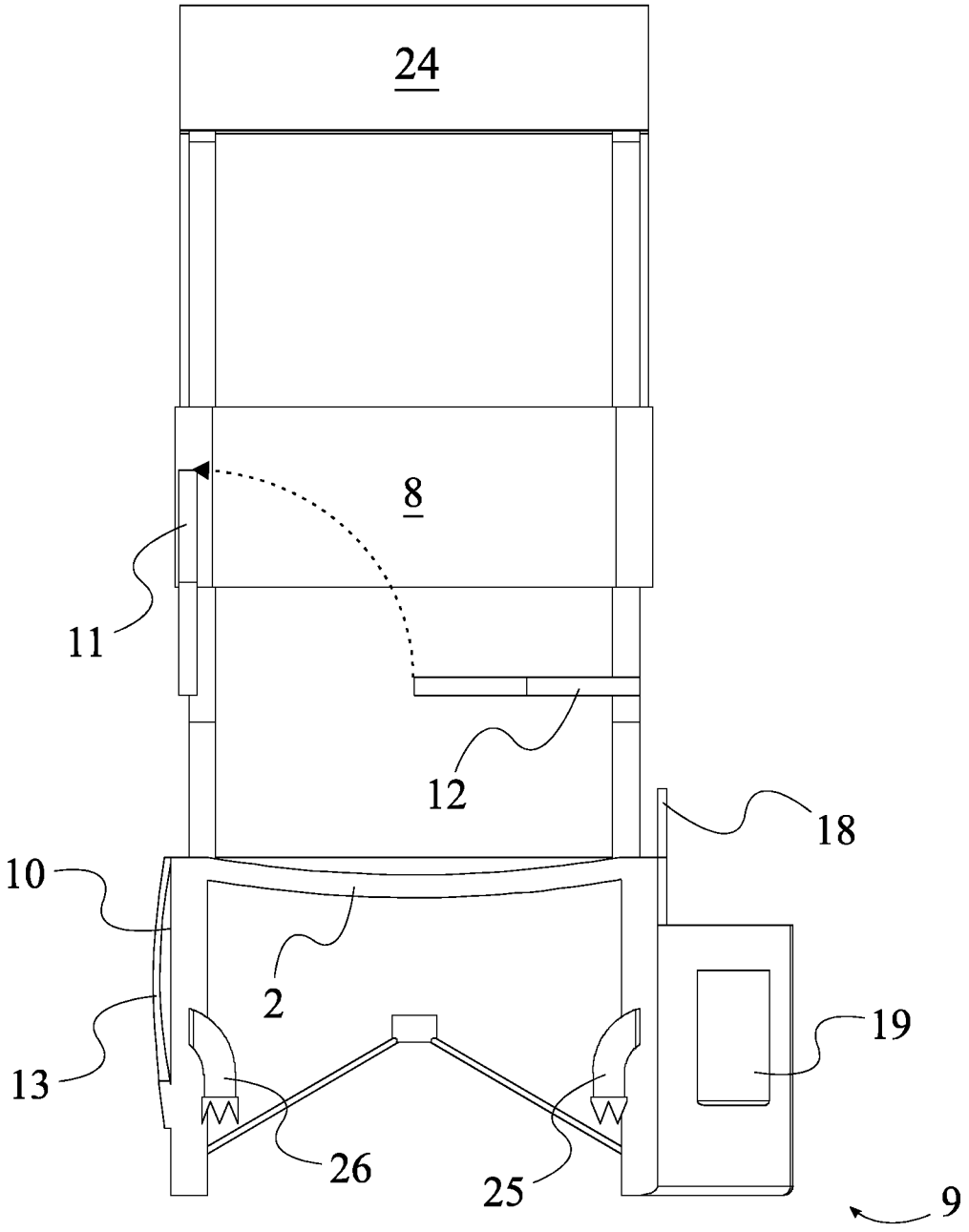
FIG. 10 is a schematic diagram representing a front view of the present invention with a telescoping table panel folding.
Figure 11:
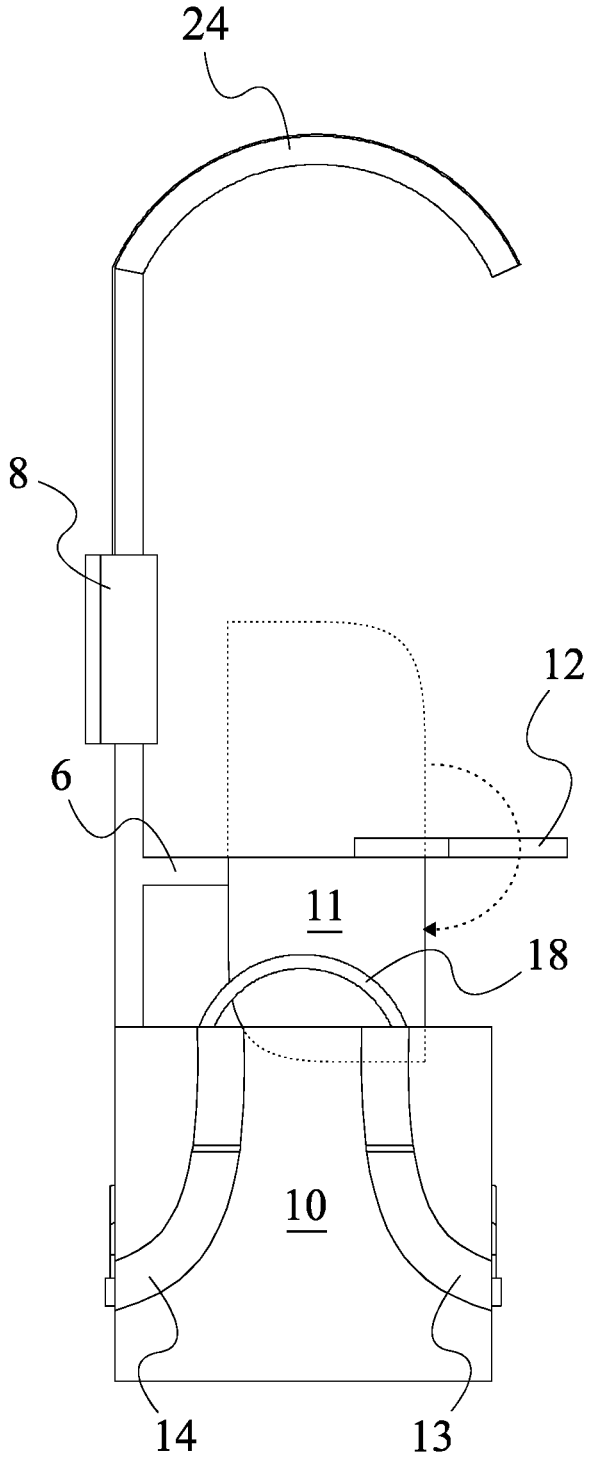
FIG. 11 is a schematic diagram representing a right view of the present invention with a telescoping table panel folding.

Alternatively, the user may desire to transport the present invention to or from a working area. In this circumstance, the chair frame 1, the pack 9, the backing 10, the first telescoping table panel 11, and the second telescoping table panel 12 are arranged in a collapsed configuration, as seen in FIGS. 8 and 9. The collapsed configuration minimizes the space occupied by the present invention, thus facilitating closure of the plurality of first buckle pieces 25 and the plurality of second buckle pieces 26 and consequently improving overall transportability. The pack 9 is perimetrically attached to the backing 10. This arrangement allows the plurality of folding legs 3 to be secured between the pack 9 and the backing 10. Furthermore, the chair frame 1, the first telescoping table panel 11, and the second telescoping table panel 12 are housed in between the pack 9 and the backing 10. In this way, the pack 9 and the backing 10 provide protection for the collapsible features of the present invention. The first telescoping table panel 11 and the second telescoping table panel 12 are able to telescope and fold into the first pocket 4 and the second pocket 5, respectively, as seen in FIGS. 10 and 11.

Figure 12:
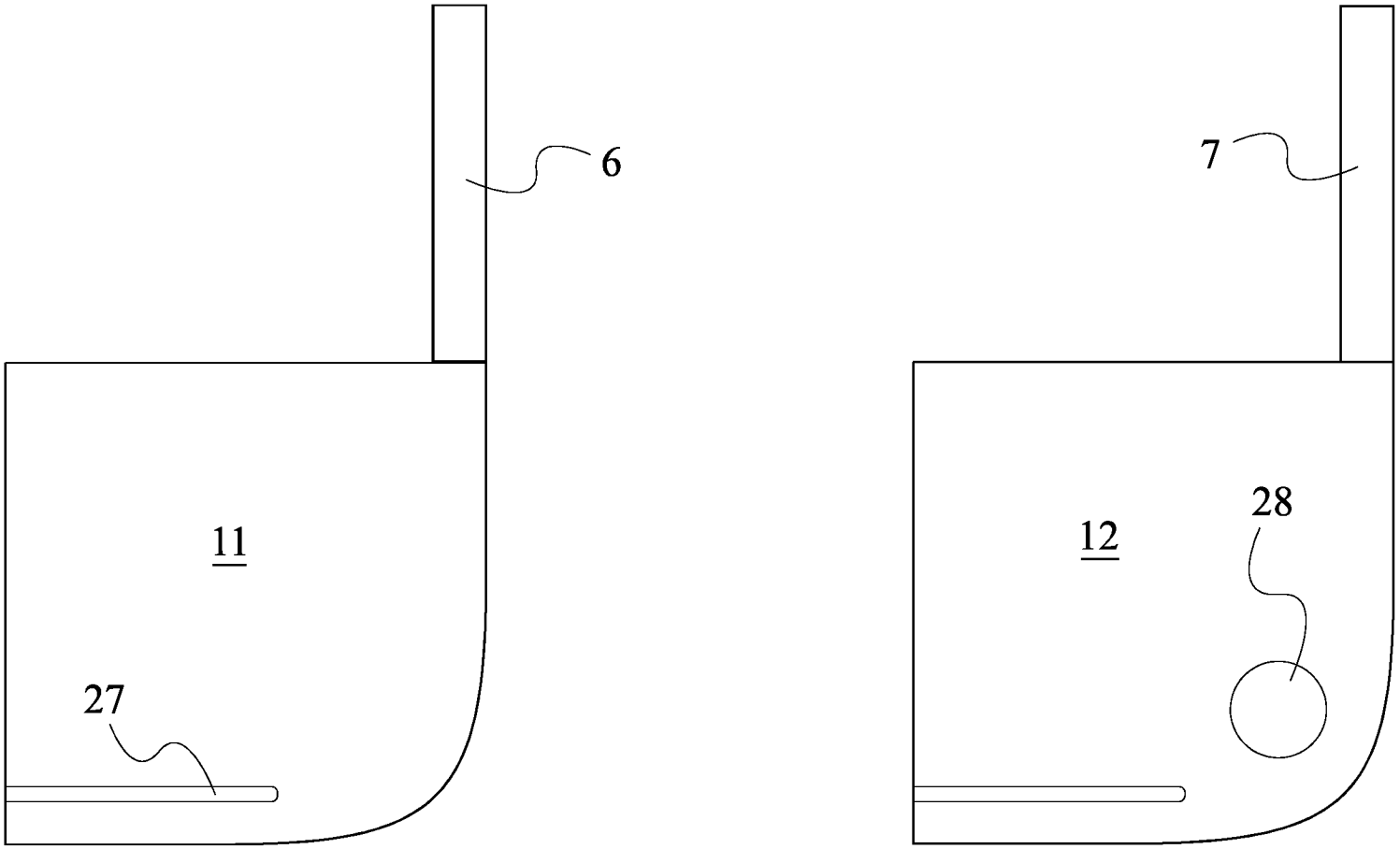
FIG. 12 is a schematic diagram representing a right view of the present invention with a telescoping table panel in an alternative arrangement.

In an exemplary embodiment, the user of the present invention may desire to utilize the first telescoping table panel 11 and the second telescoping table panel 12 in different positions. Thus, the user may adjust the first telescoping table panel 11, the second telescoping table panel 12, or both in an offset configuration, as shown in FIG. 12. This arrangement allows the user to gain better leverage onto the appropriate work surface in many use cases.

Although the invention has been explained in relation to its preferred embodiment, it is to be understood that many other possible modifications and variations can be made without departing from the spirit and scope of the invention as hereinafter claimed.

What is claimed is:

1. A portable workstation comprises:

a chair frame;

a pack;

a backing;

a first telescoping table panel;

a second telescoping table panel;

a first shoulder strap;

a second shoulder strap;

the chair frame comprises a seat, a plurality of folding legs, a first pocket, a second pocket, a first armrest, and a second armrest;

the first pocket, the second pocket, and the plurality of folding legs being peripherally mounted to the seat;

the first pocket and second pocket being positioned opposite to each other about the seat;

the plurality of folding legs being distributed about the seat;

the first armrest and the second armrest being mounted offset from the seat;

the first armrest being positioned adjacent to the first pocket;

the first telescoping table panel being laterally mounted onto the first armrest;

the second armrest being positioned adjacent to the second pocket;

the second telescoping table panel being laterally mounted onto the second armrest;

the pack being laterally mounted to the first pocket, opposite to the seat;

the backing being laterally mounted to the second pocket, opposite the seat;

the first shoulder strap and the second shoulder strap being mounted adjacent to the backing, opposite the second pocket; and the first shoulder strap being positioned offset from the second shoulder strap.

2. The portable workstation as claimed in claim 1 comprises:

a panel-joining mechanism;

the panel-joining mechanism comprises a first panel interlocking piece and a second panel interlocking piece;

the first panel interlocking piece being laterally integrated into the first telescoping table panel, opposite the first armrest; and the second panel interlocking piece being laterally integrated into the second telescoping table panel, opposite the second armrest.

3. The portable workstation as claimed in claim 2 comprises:

the first panel interlocking piece and the second panel interlocking piece being magnetically engaged to each other.

4. The portable workstation as claimed in claim 1 comprises:

a handle; and the handle being mounted adjacent to the pack, opposite the first pocket.

5. The portable workstation as claimed in claim 1 comprises:

a plurality of ancillary pockets;

the plurality of ancillary pockets being mounted adjacent to the pack, opposite the first pocket; and the plurality of ancillary pockets being distributed across the pack.

6. The portable workstation as claimed in claim 1 comprises:

at least one electrical power unit;

the at least one electrical power unit comprises a portable power source and at least one charging port;

the portable power source being mounted adjacent to the pack, opposite the first pocket; and the at least one charging port being electrically integrated into the portable power source.

7. The portable workstation as claimed in claim 1 comprises:

a wireless communication device; and the wireless communication device being mounted adjacent to the pack, opposite the first pocket.

8. The portable workstation as claimed in claim 1 comprises:

the chair frame further comprises a chair back;

the chair back being peripherally mounted to the seat; and the chair back being positioned in between the first armrest and the second armrest.

9. The portable workstation as claimed in claim 8 comprises:

a collapsible shading cover;

the collapsible shading cover being laterally connected to the chair back; and the shading cover being positioned offset from the seat.

10. The portable workstation as claimed in claim 1 comprises:

a plurality of first buckle pieces;

a plurality of second buckle pieces;

the plurality of first buckle pieces being peripherally connected to the pack; and the plurality of second buckle pieces being peripherally connected to the backing.

11. The portable workstation as claimed in claim 1 comprises:

at least one first utensil-bracing indent; and the at least one first utensil-bracing indent being integrated into the first telescoping table panel.

12. The portable workstation as claimed in claim 1 comprises:

at least one second utensil-bracing indent; and the at least one second utensil-bracing indent being integrated into the second telescoping table panel.

13. The portable workstation as claimed in claim 1 comprises:

wherein the chair frame, the pack, the backing, the first telescoping table panel, and the second telescoping table panel are arranged in an operative configuration;

the pack and the backing being positioned offset from each other;

the first armrest and the second armrest being positioned parallel to the seat; and the first telescoping table panel and the second telescoping table panel being positioned parallel to the seat.

14. The portable workstation as claimed in claim 1 comprises:

wherein the chair frame, the pack, the backing, the first telescoping table panel, and the second telescoping table panel are arranged in a collapsed configuration;

the pack being perimetrically attached to the backing; and the chair frame, the first telescoping table panel, and the second telescoping table panel being housed in between the pack and the backing.

* * * * *